US008101329B2

(12) United States Patent
Fukushima et al.

(10) Patent No.: US 8,101,329 B2
(45) Date of Patent: Jan. 24, 2012

(54) TONER AND TWO-COMPONENT DEVELOPER

(75) Inventors: Yoshihiro Fukushima, Wakayama (JP); Masahito Yamazaki, Wakayama (JP)

(73) Assignee: Kao Corporation, Tokyo (JP)

( * ) Notice: Subject to any disclaimer, the term of this patent is extended or adjusted under 35 U.S.C. 154(b) by 788 days.

(21) Appl. No.: 11/874,535

(22) Filed: Oct. 18, 2007

(65) Prior Publication Data

US 2008/0107987 A1 May 8, 2008

(30) Foreign Application Priority Data

Nov. 2, 2006 (JP) ..... 2006-299449

(51) Int. Cl.
*G03G 9/08* (2006.01)

(52) U.S. Cl. ..... 430/108.11; 430/124.4; 430/108.7; 430/108.6

(58) Field of Classification Search ..... 430/108.11, 430/108.6, 108.7, 124.4
See application file for complete search history.

(56) References Cited

U.S. PATENT DOCUMENTS

| | | | | |
|---|---|---|---|---|
| 5,034,298 | A * | 7/1991 | Berkes et al. | 430/108.2 |
| 5,482,808 | A | 1/1996 | Kondo et al. | |
| 6,303,258 | B1 * | 10/2001 | Katoh et al. | 430/110.1 |
| 6,852,460 | B2 * | 2/2005 | Nakayama et al. | 430/108.6 |
| 7,384,721 | B2 | 6/2008 | Eida et al. | |
| 2004/0219448 | A1 * | 11/2004 | Kato et al. | 430/108.6 |
| 2005/0053858 | A1 * | 3/2005 | Yuasa et al. | 430/109.4 |
| 2006/0003244 | A1 * | 1/2006 | Grande et al. | 430/106.2 |
| 2007/0148577 | A1 * | 6/2007 | Ogawa et al. | 430/108.1 |
| 2008/0070141 | A1 * | 3/2008 | Sweeney et al. | 430/108.11 |

FOREIGN PATENT DOCUMENTS

| | | | |
|---|---|---|---|
| CN | 1383037 | A | 12/2002 |
| CN | 1578933 | A | 2/2005 |
| CN | 1684005 | A | 10/2005 |
| JP | 6-332231 | | 12/1994 |
| JP | 2000-305311 | | 11/2000 |
| JP | 2003-114548 | | 4/2003 |

OTHER PUBLICATIONS

Diamond, Arthur S & David Weiss (eds.) Handbook of Imaging Materials, 2nd ed.. New York: Marcel-Dekker, Inc. (Nov. 2001) pp. 178-182.*

U.S. Appl. No. 12/107,441, filed Apr. 22, 2008, Yamazaki, et al.

Chinese Office Action mailed on Nov. 29, 2010 in corresponding Chinese Application No. 200710162281.0 (with English Translation).

Office Action issued Sep. 8, 2011, in Chinese Application No. 200710162281.0 filed Oct. 9, 2007 (with English translation).

* cited by examiner

*Primary Examiner* — Christopher Rodee

(74) *Attorney, Agent, or Firm* — Oblon, Spivak, McClelland, Maier & Neustadt, L.L.P.

(57) ABSTRACT

A toner in which mother toner particles containing at least a resin binder and a colorant are coated with an external additive, wherein the mother toner particles contain fine powders of a fluororesin having an average particle size of 1 μm or less in an amount of from 4 to 10 parts by weight, based on 100 parts by weight of the resin binder, and a toner in which mother toner particles containing at least a resin binder and a colorant are coated with an external additive, wherein the external additive contains fine powders of a fluororesin having an average particle size of 1 μm or less in an amount of from 0.3 to 2 parts by weight, based on 100 parts by weight of the mother toner particles. The toner of the present invention is suitably used for, for example, developing a latent image formed in electrophotography, electrostatic recording method, electrostatic printing method, or the like.

14 Claims, No Drawings

TONER AND TWO-COMPONENT DEVELOPER

FIELD OF THE INVENTION

The present invention relates to a toner used for, for example, developing a latent image formed in electrophotography, electrostatic recording method, electrostatic printing method, or the like; a two-component developer containing the toner; and a method of forming fixed images using the two-component developer.

BACKGROUND OF THE INVENTION

In order to provide triboelectric chargeability, fluidity, and the like to a toner, an external additive such as silica has been used. However, when a toner detains in a developing machine due to continuous use of an electrophotographic apparatus or printer for a long period of time or the like, embedment of the external additive into the toner occurs due to a high shear and agitation for charging the toner. As a solution, although a method of adding the external additive in large quantity to the toner has been known, triboelectric chargeability and fluidity would change due to worsening of fixing ability, freeing of the external additive, and change of adhesion force and cohesion force of the toner. Regarding fixing ability, in a case where the external additive is increased, it is markedly worsened, and especially it is more severely affected in a non-contact heat-fixing. In addition, due to changes in triboelectric chargeability and fluidity, in a two-component developing system controlling the toner concentration in the developer using a magnetic permeability sensor, the toner concentration cannot be controlled to a given value, and lowering of the image density due to continuous printing, or the like becomes remarkable.

In addition, there has been disclosed a technique including the step of externally adding polytetrafluoroethylene as the external additive to the toner, thereby improving cleanability of the photoconductor and preventing melt-adhesion of the developer blade and the developer roller (see JP2000-305311 A and JP2003-114548 A). Further, there has been disclosed a technique including the step of adjusting charges of a toner having small particle size with polytetrafluoroethylene to prevent lowering of the image density (see JP-A-Hei-6-332231).

SUMMARY OF THE INVENTION

The present invention relates to:

[1] a toner in which mother toner particles containing at least a resin binder and a colorant are coated with an external additive, wherein the mother toner particles contain fine powders of a fluororesin having an average particle size of 1 μm or less in an amount of from 4 to 10 parts by weight, based on 100 parts by weight of the resin binder;

[2] a toner in which mother toner particles containing at least a resin binder and a colorant are coated with an external additive, wherein the external additive contains fine powders of a fluororesin having an average particle size of 1 μm or less in an amount of from 0.3 to 2 parts by weight, based on 100 parts by weight of the mother toner particles;

[3] a two-component developer containing the toner as defined in the above [1] or [2] and a carrier; and

[4] a method of forming fixed images, including the step of applying the two-component developer as defined in the above [3] to a non-contact fixing type image-forming apparatus.

DETAILED DESCRIPTION OF THE INVENTION

The present invention relates to a toner maintaining an excellent fixed image and having excellent fixing ability even during a long-term durability printing at a low printing ratio; a two-component developer containing the toner; and a method of forming fixed images using the two-component developer.

The toner of the present invention maintains an excellent fixed image and exhibits an excellent effect in fixing ability also in a long-term durability printing at a low printing ratio.

These and other advantages of the present invention will be apparent from the following description.

The toner of the present invention is a toner in which mother toner particles contain at least a resin binder and a colorant are coated with an external additive, wherein the toner has the mother toner particles containing specified fine powders of a fluororesin in a specified amount (Embodiment 1) and wherein the toner has the external additive containing fine powders of a specified fluororesin in a specified amount (Embodiment 2), and has a feature that specified fine powders of a fluororesin are contained in a specified amount in each of the toners. It has been found that fine powders of a fluororesin having a specified particle size are internally added or externally added to a toner in a specified amount, whereby the fine powders of the fluororesin having excellent slip property adequately reside on the top surface of fixed images, so that the toner has favorable fixing ability which is excellent in both rubbing property and durability, especially also in a fixing system like a non-contact heat-fixing in which the more excellent fixing ability is desired. The present invention also includes a toner obtainable by further adding fine powders of a fluororesin to the mother toner particles containing fine powders of a fluororesin, i.e., a toner of the combination of the toners of Embodiment 1 and Embodiment 2.

The fine powders of the fluororesin used for the toners of Embodiments 1 and 2 have an average particle size of 1 μm or less, preferably from 0.1 to 1 μm, more preferably from 200 to 800 nm, and even more preferably from 250 to 600 nm, from the viewpoint of fixing ability, prevention of filming to the photoconductor or the like, and prevention of freeing. In the present specification, an average particle size of the fine powders of the fluororesin is calculated from a number-average of particle size determined from a photograph taken with an electron microscope.

The fine powders of the fluororesin include polytetrafluoroethylene, trifluoroethylene, vinylidene fluororide, fluoroethylene, or the like. Among them, polytetrafluoroethylene having a high melting point and a low coefficient of friction is preferred.

Polytetrafluoroethylene having a nearly spherical shape produced according to emulsion polymerization is preferable. Commercially available products of polytetrafluoroethylene having such a shape include, "LUBRON L2" (commercially available from DAIKIN INDUSTRIES, Ltd., average particle size of 300 nm), "LUBRON L5" (commercially available from DAIKIN INDUSTRIES, Ltd., average particle size of 200 nm), "KTL-500F" (commercially available from KITAMURA LIMITED, average particle size of 500 nm), and the like.

In the toner of Embodiment 1, the fine powders of the fluororesin are contained in an amount of from 4 to 10 parts by weight, and preferably from 6 to 10 parts by weight, based on 100 parts by weight of the resin binder, of the mother toner particles, from the viewpoint of improvement in fixing ability.

The fine powders of the fluororesin are contained in an amount of from 0.3 to 2 parts by weight, preferably from 0.4 to 1.5 parts by weight, and more preferably from 0.5 to 1.0 parts by weight, based on 100 parts by weight of the mother toner particles, of the toner of Embodiment 2, from the viewpoint of prevention of filming to the photoconductor and improvement in fixing ability.

In addition, the fine powders of the fluororesin are contained in an amount of preferably 5.7% by weight or more, more preferably from 5.7 to 29% by weight, and even more preferably from 7.5 to 23% by weight, of the external additive in the toner of Embodiment 2, from the viewpoint of prevention of filming to the photoconductor and improvement in fixing ability.

The external additive in the toner of Embodiment 1 and the external additive other than the fine powders of the fluororesin in the toner of Embodiment 2 include, for example, as the fine inorganic particles, an inorganic oxide selected from the group consisting of silica, titania, alumina, zinc oxide, magnesium oxide, cerium oxide, iron oxide, copper oxide, and tin oxide or the like. These can be used alone or in admixture of two or more kinds. Among them, silica is preferable from the viewpoint of improvement in triboelectric chargeability and fluidity.

As the silica, those prepared by a known method can be used. The silica prepared by dry method or high-temperature hydrolysis method are preferable from the viewpoint of dispersibility of the silica. In addition, besides anhydrous silica, the silica may contain aluminum silicate, sodium silicate, potassium silicate, magnesium silicate, zinc silicate, or the like. The silica containing $SiO_2$ in an amount of 80% by weight or more is preferable, and the silica containing $SiO_2$ in an amount of 85% by weight or more is more preferable.

The surface of the fine inorganic particles may be subjected to hydrophobic treatment, and it is preferable that the silica is treated with a hydrophobic treatment agent. The hydrophobic treatment method is not particularly limited, as long as a hydrophobic treatment agent is adsorbed to the surface of the silica by the method. A method including the steps of spraying a solution prepared by diluting a hydrophobic treatment agent in a solvent to silica in a mixing vessel while stirring, and heating and drying for a given period of time in the vessel with continuously stirring is exemplified. The hydrophobic treatment agent includes hexamethyl disilazane (HMDS), dimethyl dichlorosilane (DMDS), silicone oil, methyl triethoxysilane, and the like. Among them, hexamethyl disilazane is preferable. The fine inorganic particles are treated with the hydrophobic treatment agent in an amount of preferably from 1 to 7 $mg/m^2$ per a surface area of the fine inorganic particles.

In the present invention, from the viewpoint of more solidly adhering the fine powders of the fluororesin and the fine inorganic particles (hereinafter also referred to as fine inorganic particles A) to the mother toner particles, it is preferable that the fine inorganic particles A are externally added to the mother toner particles, and thereafter, fine inorganic particles B having an average particle size smaller than that of the fine inorganic particles A are further externally added to the mother toner particles.

The fine inorganic particles A have an average particle size of preferably from 5 to 300 nm, more preferably from 10 to 100 nm, and even more preferably from 10 to 60 nm, from the viewpoint of triboelectric chargeability and fluidity, and further, prevention of embedment. The average particle size of the fine inorganic particles A as used herein is an average particle size of all the fine inorganic particles A used in the toner of the present invention as the external additive.

The fine inorganic particles B have an average particle size of preferably from 5 to 100 nm, more preferably from 5 to 60 nm, and even more preferably from 10 to 50 nm.

The average particle size ratio of the fine inorganic particles A to the fine inorganic particles B, i.e., average particle size of fine inorganic particles A/average particle size of fine inorganic particles B, is preferably from 1.2 to 5, and more preferably from 1.8 to 3.5. In addition, the difference of the average particle sizes between the fine inorganic particles A and the fine inorganic particles B is preferably 5 nm or more.

The fine inorganic particles A are externally added to the mother toner particles in an amount of preferably from 3 to 10 parts by weight, more preferably from 3 to 9 parts by weight, and even more preferably 4 to 8 parts by weight, based on 100 parts by weight of the mother toner particles, from the viewpoint of prevention of embedment.

The fine inorganic particles B are externally added to the mother toner particles in an amount of preferably from 0.5 parts by weight or more, more preferably from 0.5 to 4 parts by weight, and even more preferably 0.7 to 2 parts by weight, based on 100 parts by weight of the mother toner particles.

When the fine inorganic particles B are used together with the fine inorganic particles A, a weight ratio of the fine inorganic particles A to the fine inorganic particles B, i.e., fine inorganic particles A/fine inorganic particles B, is preferably from 1 to 6, and more preferably from 3 to 5, from the viewpoint of improvement in durability.

In addition, in the toner of Embodiment 2, it is desired that a total coating ratio of the external additive is preferably 70% or more, more preferably 80% or more, even more preferably from 80 to 200%, and even more preferably from 90 to 150%, from the viewpoint of prevention of embedment, the viewpoint of improvement in durability, and the viewpoint of stability of toner concentration and image density. In the present invention, a coating ratio is determined according to the method described in Example later, and a total coating ratio refers to the total of the coating ratios of the fine inorganic particles and the fine powders of the fluororesin used.

In Embodiments 1 and 2 of the present inventions, the mother toner particles contain at least a resin binder and a colorant.

The resin binder includes polyesters, vinyl resins such as styrene-acrylic resins, epoxy resins, polycarbonates, polyurethanes, composite resins containing two or more resin components, and the like. Among them, polyester is preferable from the viewpoint of durability. The polyester is contained in an amount of preferably from 50 to 100% by weight, and more preferably from 70 to 100% by weight, of the resin binder. As the composite resin, a resin in which a polycondensation resin such as a polyester, a polyester-polyamide, or a polyamide, and an addition polymerization resin such as a vinyl polymer-based resin are partially chemically bonded to each other is preferable. The composite resin may be obtained from two or more resins as raw materials, the composite resin may be obtained from one kind of resin and raw material monomers for the other resin, or further the composite resin may be obtained from a mixture of raw material monomers of two or more resins. In order to efficiently obtain a composite resin, those obtained from a mixture of raw material monomers of two or more resins are preferable.

A raw material monomer for the polyester is not particularly limited, and a known alcohol component and a known carboxylic acid component such as carboxylic acids, acid anhydrides thereof and esters thereof are used.

It is preferable that the alcohol component contains a compound represented by the formula (I):

(I)

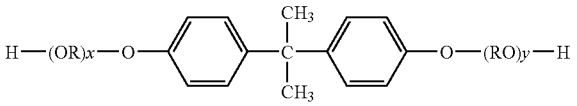

wherein RO is an alkylene oxide; R is an alkylene group having 2 or 3 carbon atoms; x and y are positive numbers showing an average number of moles of alkylene oxide added, wherein a sum of x and y is from 1 to 16, and preferably from 1.5 to 5.

The compound represented by the formula (I) includes an alkylene (2 or 3 carbon atoms) oxide (average number of moles: 1 to 16) adduct of bisphenol A, such as polyoxypropylene(2.2)-2,2-bis(4-hydroxyphenyl)propane and polyoxyethylene(2.0)-2,2-bis(4-hydroxyphenyl)propane, and the like. In addition, other alcohol component include ethylene glycol, propylene glycol, glycerol, pentaerythritol, trimethylolpropane, hydrogenated bisphenol A, sorbitol, or an alkylene (2 to 4 carbon atoms) oxide (average number of moles: 1 to 16) adduct thereof, and the like, and it is preferable that one or more of these compounds are contained in the alcohol component.

The compound represented by the formula (I) is contained in an amount of preferably 5% by mole or more, more preferably 50% by mole or more, and even more preferably substantially 100% by mole, of the alcohol component.

In addition, the carboxylic acid component includes dicarboxylic acids such as phthalic acid, isophthalic acid, terephthalic acid, fumaric acid, maleic acid, adipic acid, and succinic acid; a substituted succinic acid of which substituent is an alkyl group having 1 to 20 carbon atoms or an alkenyl group having 2 to 20 carbon atoms, such as dodecenylsuccinic acid or octenylsuccinic acid; tricarboxylic or higher polycarboxylic acids such as trimellitic acid and pyromellitic acid; acid anhydrides thereof; alkyl (1 to 8 carbon atoms) esters thereof; and the like.

The polyester can be obtained by, for example, polycondensation of the alcohol component and the carboxylic acid component at a temperature of from 180° to 250° C. in an inert gas atmosphere, using an esterification catalyst as desired.

The polyester has a softening point of preferably from 90° to 170° C. and more preferably from 100° to 165° C., from the viewpoint of durability and fixing ability.

When the toner of the present invention is used as a positively chargeable toner, the polyester has an acid value of preferably from 0.5 to 15 mgKOH/g, more preferably from 1 to 12 mgKOH/g, and even more preferably from 1.5 to 10 mgKOH/g.

In addition, when the toner of the present invention is used as a negatively chargeable toner, the polyester has an acid value of preferably from 5 to 40 mgKOH/g, more preferably from 10 to 35 mgKOH/g, and even more preferably from 15 to 30 mgKOH/g.

As the colorant, a dye, a pigment, or the like which is used as a colorant for a toner can be used. The colorant includes carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, Carmine 6B, Disazoyellow, and the like. These colorants can be used alone or in admixture of two or more kinds. The toner of the present invention may be either black toners or color toners. The colorant is contained in an amount of preferably from 1 to 40 parts by weight, and more preferably from 3 to 10 parts by weight, based on 100 parts by weight of the resin binder.

Further, the toners of Embodiments 1 and 2 of the present invention may properly contain an additive such as a charge control agent, a releasing agent, an electric conductivity modifier, an extender, a reinforcing filler such as a fibrous substance, an antioxidant, an anti-aging agent, or a magnetic material.

The charge control agent includes a positively chargeable charge control agent such as a Nigrosine dye, a triphenylmethane-based dye containing a tertiary amine as a side chain, a quaternary ammonium salt compound, a polyamine resin and an imidazole derivative; and a negatively chargeable charge control agent such as a metal-containing azo dye, a copper phthalocyanine dye, a metal complex of an alkyl derivative of salicylic acid, and boron complex of benzilic acid. The charge control agent is contained in an amount of preferably from 0.1 to 5 parts by weight, and more preferably from 0.5 to 2 parts by weight, based on 100 parts by weight of the resin binder.

The releasing agent includes an aliphatic hydrocarbon wax such as a low-molecular weight polypropylene, a low-molecular weight polyethylene, a low-molecular weight polypropylene-polyethylene copolymer, microcrystalline wax, paraffin wax, Fischer-Tropsch wax, and the like, and oxides thereof; an ester wax such as carnauba wax, montan wax, Sazole wax, deoxidized waxes thereof, and the like; fatty acid amides; fatty acids; higher alcohols; metal salts of fatty acids; and the like. Among them, the aliphatic hydrocarbon wax and the ester wax are preferable from the viewpoint of releasing property and stability, and the ester wax is more preferable and carnauba wax is even more preferable from the viewpoint of fixing ability. These releasing agents may be contained alone or in admixture of two or more kinds. The releasing agent is contained in an amount of preferably from 0.5 to 10 parts by weight, and more preferably from 1 to 5 parts by weight, based on 100 parts by weight of the resin binder.

The toner of the present invention can be produced according to a known method such as a kneading-pulverization method, a spray-drying method, or a polymerization method. A pulverized toner obtainable according to the kneading-pulverization method is preferable because the resin binder is excellent in pulverizability. According to a general method of the kneading-pulverization method, the mother toner particles of Embodiment 1 or Embodiment 2 can be obtained, for example, by mixing a resin binder, a colorant, various additives as desired, and the like, as well as the fine powders of the fluororesin in Embodiment 1, with a mixer such as a Henschel mixer or a ball-mill, thereafter melt-kneading with a closed kneader, a single-screw or twin-screw extruder or the like, at this point, it is preferable in Embodiment 1 in that a kneading temperature is set at a temperature lower than a softening point of the resin binder and whereby the fine powders of the fluororesin can be properly dispersed, cooling the product, thereafter roughly pulverizing with a hammer-mill or the like, further, finely pulverizing with a fine pulverizer utilizing jet stream or a mechanical pulverizer, and classifying the product to a given particle size with a classifier utilizing gyratory stream or a classifier utilizing a Coanda effect.

Further, the external additive is added to the mother toner particles obtained as described above, and in Embodiment 2, the external additive containing the fine powders of the fluororesin is added to the mother toner particles obtained as described above. It is preferable that the external additive is externally added to the mother toner particles according to dry mixing method using a high-speed mixer such as a Henschel mixer or a Super mixer, a V blender, or the like. In addition, when the fine powders of the fluororesin and the external additive other than the fine powders of the fluororesin are used together in Embodiment 2, the fine powders of the fluororesin and the external additive other than the fine powders of the fluororesin (hereinafter also referred to as "other external additive") may be simultaneously or separately added thereto. Even when the other external additive is embedded to some extent, the fine powders of the fluororesin is less likely to detach from the mother toner particles, triboelectric chargeability and fluidity are not impaired, filming is also prevented, and toner density and image density are stabilized. Therefore, it is preferable that the fine powders of the fluororesin and the other external additive are simultaneously added thereto. Concretely, when the fine powders of the fluororesin and the fine inorganic particles A and B are used together, it is preferable that the fine powders of the fluororesin and the fine inorganic particles A are simultaneously externally added to the mother toner particles (the first step), and thereafter the fine inorganic particles B are further externally added thereto (the second step), since the fine powders of the fluororesin and the fine inorganic particles more solidly adhere to the mother toner particles thereby. Also when the fine inorganic particles A and B are used together in Embodiment 1, it is preferable that the step of externally adding the fine inorganic particles A to the mother toner particles is carried out, and thereafter the step of externally adding the fine inorganic particles B to the mother toner is carried out as described above.

The toner of the present invention has a volume-median particle size ($D_{50}$) of preferably from 5 to 12.5 μm and more preferably from 6 to 10 μm, from the viewpoint of easiness to handle as fine particles. The term "volume-median particle size ($D_{50}$)" as used herein refers to a particle size of which cumulative volume frequency calculated on a volume percentage is 50% counted from the smaller particle sizes.

Since the toner of the present invention maintains an excellent fixed image and exhibits an excellent effect in fixing ability also in a long-term durability printing at a low printing ratio, it can be suitably used as a toner for a non-contact heat-fixing. In addition, the toner of the present invention can be used as a toner for monocomponent development as it is or as a two-component developer by mixing the toner with a carrier.

Therefore, the present invention also provides a two-component developer containing the above-mentioned toner and a carrier.

In the two-component developer of the present invention, it is presumed that fine powders of a specified fluororesin, preferably polytetrafluoroethylene, have a melting point higher than other fluororesins such as poly(vinylidene fluoride), so that not only the fine powders of a specified fluororesin migrated to a carrier do not melt-adhered and lowering of triboelectric charges can be prevented, but also, even the detailed reasons therefor are unknown, polytetrafluoroethylene mitigates freeing of the silica and migration of the silica to the carrier, to prevent lowering of triboelectric chargeability of the toner and fluidity of the developer.

In the present invention, as a carrier, it is preferable to use a carrier having a low saturated magnetization, which forms a soft magnetic brush, from the viewpoint of the properties of fixed images. The carrier has a saturated magnetization of preferably from 40 to 100 $Am^2/kg$ and more preferably from 50 to 90 $Am^2/kg$. A saturated magnetization is preferably 100 $Am^2/kg$ or less from the viewpoint of adjusting hardness of the magnetic brush and retaining tone reproductivity, and is preferably 40 $Am^2/kg$ or more from the viewpoint of preventing carrier adhesion and toner scattering.

As a core material for the carrier, a core material made from any known materials can be used without particular limitation. The core material includes, for example, ferromagnetic metals such as iron, cobalt and nickel; alloys and compounds such as magnetite, hematite, ferrite, copper-zinc-magnesium-based ferrite, manganese-based ferrite, and magnesium-based ferrite; glass beads; and the like. Among them, magnetite, ferrite, copper-zinc-magnesium-based ferrite, and manganese-based ferrite are preferable.

The surface of the carrier may be coated with a resin from the viewpoint of triboelectric chargeability prevention of toner spent. The resin for coating the surface of a carrier varies depending upon the materials for the toner. The resin includes, for example, a fluororesin such as polytetrafluoroethylene, a monochlorotrifluoroethylene polymer, poly(vinylidene fluoride), a silicone resin such as polydimethylsiloxane, a polyester, a styrenic resin, an acrylic resin, polyamide, polyvinyl butyral, an aminoacrylate resin, and the like. These resins can be used alone or in admixture of two or more kinds. The method for coating the core material with the resin is not particularly limited. The method of coating the core material by the resin includes, for example, a method including the steps of dissolving or suspending a coating material such as a resin in a solvent, and applying the resulting solution or suspension to the core material to allow the resin to adhere thereto; a method including the step of simply mixing the core material with the resin in powdery forms; and the like.

In the two-component developer of the present invention obtainable by mixing the toner and the carrier, the toner is contained in an amount of preferably from 0.5 to 10 parts by weight and more preferably from 2 to 8 parts by weight, based on 100 parts by weight of the carrier.

The two-component developer of the present invention can maintain excellent image quality in a long-term durability printing at a low printing ratio also in the case of the two-component development method including the step of continuously agitating the toner. Therefore, the two-component developer of the present invention can be also suitably used in a method of forming fixed images employing a developing apparatus having an organic photoconductor and a high-speed developing apparatus with a linear speed of 370 mm/sec or more of which durability such as prevention of filming to the photoconductor is required.

In addition, the two-component developer of the present invention can be used for any of fixing systems of a contact fixing system and a non-contact fixing system. The two-component developer of the present invention is applied in a non-contact fixing type image-forming apparatus of which the more excellent fixing ability is required, such as a fixing device of oven fixing, flash fixing, or belt nip system, whereby the effects of the present invention are more remarkably exhibited. Therefore, the present invention further provides a method of forming fixed images including the step of applying the two-component developer of the present invention to a non-contact fixing type image-forming apparatus.

According to the method of forming fixed images of the present invention, fixed images can be formed through known steps except that the method has a feature in the fixing step where a transferred toner image is fixed. The steps in the method of forming fixed images include, other than the fixing step, for example, the steps of forming an electrostatic latent image on the surface of a photoconductor (charging and exposing step); developing an electrostatic latent image (developing step); transferring the developed toner image to an image-bearing material such as paper (transferring step); removing the toner remaining on a developing member such as a photoconductive drum (cleaning step); and the like.

EXAMPLES

The following examples further describe and demonstrate embodiments of the present invention. The examples are given solely for the purposes of illustration and are not to be construed as limitations of the present invention.

[Softening Point of Resin]

The softening point refers to a temperature at which a half the amount of the sample flows out when plotting a downward movement of a plunger against temperature, as measured by using a flow tester (CAPILLARY RHEOMETER "CFT-500D," commercially available from Shimadzu Corporation), in which a 1 g sample is extruded through a nozzle having a diameter of 1 mm and a length of 1 mm while heating the sample so as to raise the temperature at a rate of 6° C./min and applying a load of 1.96 MPa thereto with the plunger.

[Glass Transition Temperature of Resin]

The glass transition temperature refers to a temperature of an intersection of the extension of the baseline of equal to or lower than the temperature of the endothermic highest peak and the tangential line showing the maximum inclination between the kick-off of the peak and the top of the peak, which is determined using a differential scanning calorimeter ("DSC 210," commercially available from Seiko Instruments, Inc.), by raising its temperature to 200° C., cooling the sample from this temperature to 0° C. at a cooling rate of 10° C./min, and thereafter raising the temperature of the sample at a heating rate of 10° C./min.

[Acid Value of Resin]

The acid value is determined by a method according to JIS K0070 except that only the determination solvent was changed from a mixed solvent of ethanol and ether as prescribed according to JIS K0070 to a mixed solvent of acetone and toluene (volume ratio of acetone:toluene=1:1).

[Volume-Median Particle Size ($D_{50}$) of Mother Toner Particles and Toner]

Measuring Apparatus Coulter Multisizer II (commercially available from Beckman Coulter K.K.)

Aperture Diameter: 50 μm

Analyzing Software: Coulter Multisizer AccuComp Ver. 1.19 (commercially available from Beckman Coulter K.K.)

Electrolytic solution: "Isotone II" (commercially available from Beckman Coulter K.K.)

Dispersion: "EMULGEN 109P" (commercially available from Kao Corporation, polyoxyethylene lauryl ether, HLB: 13.6) is dissolved in the above electrolytic solution so as to have a concentration of 5% by weight, to give a dispersion.

Dispersion Conditions Ten milligrams of a test sample is added to 5 mL of the above dispersion, and the resulting mixture is dispersed in an ultrasonic disperser for 1 minute. Thereafter, 25 mL of the electrolytic solution is added to the dispersion, and the resulting mixture is dispersed in the ultrasonic disperser for another 1 minute, to give a sample dispersion.

Measurement Conditions The above sample dispersion is adjusted so as to have a concentration at which the particle sizes of 30,000 particles can be determined in 20 seconds by adding 100 mL of the above electrolytic solution to the above sample dispersion. Thereafter, the particle sizes of 30,000 particles are determined to obtain a volume-median particle size ($D_{50}$) from the particle size distribution.

[Average Particle Size of Fine Inorganic Particles]

The average particle size refers to a number-average particle size and is calculated according to the following formula:

$$\text{Number-Average Particle Size(nm)}=6/(\rho\times\text{Specific Surface Area}(m^2/g))\times 1000,$$

wherein ρ is a specific gravity of the fine inorganic particles, and the specific gravity of silica is 2.3. The specific surface area is a BET specific surface area obtained by nitrogen absorption method. In the case of hydrophobically treated fine inorganic particles, a specific surface area of the original fine inorganic particles before hydrophobic treatment is used.

Supposing that the fine inorganic particles are spheres having a particle size of R, the above formula can be obtained by the following formulae:

$$\text{BET Specific Surface Area}=S\times(1/m)$$

$$m(\text{Weight of Particles})=4/3\times\pi\times(R/2)^3\times\text{Specific Gravity}$$

$$S(\text{Surface Area})=4\pi(R/2)^2$$

[Average Particle Size of Fine Powders of Fluororesin]

The average particle size refers to a number-average particle size.

For the number-average particle size, particle sizes (an average of a major axis and a minor axis) of one hundred particles are determined with a scanning electron microscope in proper imaging magnification from 5000 to 50000 times, and the average thereof is defined as an average particle size of the fine powders of resin.

[Coating Ratio of External Additive]

The coating ratio is calculated by the following formula:

$$\text{Coating Ratio}(\%)=\sqrt{3}/2\pi\times(D\cdot\rho t)/(d\cdot\rho s)\times C\times 100$$

wherein D is a volume-median particle size ($D_{50}$) of mother toner particles (μm); d is an average particle size of an external additive (μm); ρt is a specific gravity of mother toner particles; ρs is a specific gravity of an external additive (silica: 2,3-polytetrafluoroethylene:2.1); and C is a weight ratio of mother toner particles to an external additive, i.e., external additive/mother toner particles.

[Saturated Magnetization of Carrier]

(1) A carrier is filled in a plastic case with a lid with tapping, the case having an outer diameter of 7 mm (an inner diameter of 6 mm) and a height of 5 mm. The mass of the carrier is determined from the difference of the weight of the plastic case and the weight of the plastic case filled with the carrier.

(2) The plastic case filled with the carrier is set in a sample holder of a device for measuring magnetic property "BHV-50H" (V. S. MAGNETOMETER) commercially available from Riken Denshi Co., Ltd. The saturated magnetization is determined by applying a magnetic field of 79.6 kA/m, with vibrating the plastic case using the vibration function. The value obtained is calculated as the saturated magnetization per unit mass, taking into consideration the mass of the filled carrier.

Production Example 1 for Resin

The amount 1,050 g of polyoxypropylene(2.2)-2,2-bis(4-hydroxyphenyl)propane, 355 g of fumaric acid, 1 g of hydroquinone (polymerization inhibitor) and 1.4 g of dibutyltin oxide (esterification catalyst) were reacted at 210° C. for 5 hours at an atmospheric pressure under a nitrogen gas atmosphere. Thereafter, the ingredients were further reacted at 210° C. under reduced pressure, to give a resin A. The resin A had a softening point of 102.0° C., an acid value of 19.8 mgKOH/g, and a glass transition point of 58.0° C.

Production Example 2 for Resin

The amount 830 g of polyoxypropylene(2.2)-2,2-bis(4-hydroxyphenyl)propane, 320 g of polyoxyethylene(2.0)-2,2-bis(4-hydroxyphenyl)propane, 233 g of terephthalic acid, 245 g of dodecenylsuccinic anhydride, 140 g of trimellitic anhydride and 4 g of dibutyltin oxide (esterification catalyst) were reacted at 230° C. for 8 hours at an atmospheric pressure under a nitrogen gas atmosphere. Thereafter, the ingredients were further reacted under reduced pressure, to give a resin B. The resin B had a softening point of 138.5° C., an acid value of 25.8 mgKOH/g, and a glass transition point of 65.8° C.

Examples 1 to 4 and Comparative Examples 1 to 4

The amount 80 parts by weight of the resin A and 20 parts by weight of the resin B as resin binders, 6 parts by weight of a carbon black "MOGUL-L" (commercially available from Cabot Corporation) as a colorant, 1 part by weight of "BONTRON S-34" (commercially available from Orient Chemical Co., Ltd.), 0.15 parts by weight of "BONTRON NO-7" (commercially available from Orient Chemical Co., Ltd.) as charge control agents and 2 parts by weight of "Carnauba Wax C1" (commercially available from Kato Yoko), and polytetrafluoroethylene "KTL-500F" (commercially available from KITAMURA LIMITED) as shown in Table 1 were mixed with a Henschel mixer. Thereafter, the mixture was melt-kneaded at a kneading temperature of 90° C. with a twin-screw extruder "PCM-45" (commercially available from IKEGAI Corporation), cooled with a drum flaker, and then roughly pulverized with a cutter mill. Thereafter, the roughly pulverized product was finely pulverized with a jet mill, and classified with a rotary stream classifier, to give mother toner particles having a volume-median particle size ($D_{50}$) of 8.5 μm.

A hydrophobic silica "NAX50" (commercially available from Nippon Aerosil) as shown in Table 1 was added to 100 parts by weight of the resulting mother toner particles, and the mixture was mixed with a Henschel mixer for 240 seconds. Thereafter, a hydrophobic silica "R-972" (commercially available from Nippon Aerosil) as shown in Table 1 was further added thereto and the mixture was mixed with a Henschel mixer for 240 seconds. Thereafter, the mixture was sieved through a wire mesh having a sieve opening of 100 μm, to give a negatively chargeable toner.

Test Example 1

Fixing Ability

The amount 6 parts by weight of a toner and 100 parts by weight of a ferrite carrier (average particle size: 65 μm, saturated magnetization: 69 $Am^2/kg$) were loaded on a "Variostream 9000" commercially available from Oce Printing Systems GmbH, and 50,000 sheets were durably printed at a printing ratio of 9%. The image density of the resulting fixed image was determined with a measuring apparatus of image densities "SPM-50" (commercially available from Gretag Macbeth AG), and the fixed image sample having the image density of from 1.9 to 2.1 was collected. A tape peeling test and a paper rubbing test were carried out with the collected samples to evaluate fixing ability. In a tape peeling test, the image densities of the image sample before and after adhering a tape were determined and a tape peeling residual ratio was obtained according to the following formula:

Tape Peeling Residual Ratio(%)=Image Density After Tape Peeling/Image Density Before Tape Sticking×100

In addition, in a paper rubbing test, the fixed image portion of the above fixed image sample was rubbed 10 times with a white paper, and a stain adhered to the white paper was determined with a "X-Rite MODEL938" (commercially available from X-Rite). The results are shown in Table 1.

TABLE 1

| | Internal Additive (Parts by Weight) | | | | | | External Additive[1)] (Parts by Weight) | | Fixing Ability | |
|---|---|---|---|---|---|---|---|---|---|---|
| | Resin Binder | MOGUL-L | BONTRON S-34 | BONTRON NO-7 | Carnauba Wax C1 | Fine Powders of Fluororesin KTL-500F | R-972 | NAX50 | Tape Peeling Residual Ratio (%) | Stain by Paper Rubbing (%) |
| Ex. 1 | A/B = 80/20 | 6 | 1 | 0.15 | 2 | 4 | 0.9 | 4.0 | 81 | 1.9 |
| Ex. 2 | A/B = 80/20 | 6 | 1 | 0.15 | 2 | 6 | 0.9 | 4.0 | 79 | 1.7 |
| Ex. 3 | A/B = 80/20 | 6 | 1 | 0.15 | 2 | 8 | 0.9 | 4.0 | 77 | 1.7 |
| Ex. 4 | A/B = 80/20 | 6 | 1 | 0.15 | 2 | 10 | 0.9 | 4.0 | 72 | 1.7 |
| Comp. Ex. 1 | A/B = 80/20 | 6 | 1 | 0.15 | 2 | 0 | 0.9 | 4.0 | 84 | 11 |
| Comp. Ex. 2 | A/B = 80/20 | 6 | 1 | 0.15 | 2 | 0.4 | 0.9 | 4.0 | 84 | 10 |
| Comp. Ex. 3 | A/B = 80/20 | 6 | 1 | 0.15 | 2 | 0.7 | 0.9 | 4.0 | 84 | 8 |
| Comp. Ex. 4 | A/B = 80/20 | 6 | 1 | 0.15 | 2 | 2 | 0.9 | 4.0 | 83 | 5 |

Note)

MOGUL-L: carbon black, commercially available from Cabot Corporation

BONTRON S-34: commercially available from Orient Chemical Co., Ltd

BONTRON NO-7: commercially available from Orient Chemical Co., Ltd

Carnauba Wax C1: commercially available from Kato Yoko

KTL-500F: polytetrafluoroethylene, commercially available from KITAMURA LIMITED, average particle size of 500 nm NAX50: hydrophobic silica, commercially available from Nippon Aerosil, hexamethyl disilazane as a hydrophobic treatment agent, average particle size of 55 nm R-972: hydrophobic silica, commercially available from Nippon Aerosil, dimethyl dichlorosilane as a hydrophobic treatment agent, average particle size of 21 nm

[1)]The amount of the external additive is expressed by parts by weight, based on 100 parts by weight of the mother toner particles.

It can be seen from the above results that, the toners of Examples 1 to 4 do not dramatically lower a tape peeling residual ratio even the amounts of the fine powders of the fluororesin are increased, and dramatically lower stain by paper rubbing, so that these toners are excellent in fixing ability as compared to the toners of Comparative Examples 1 to 4. In addition, Comparative Example 2 containing the fine powders of the fluororesin in an amount of 0.4 parts by weight, Comparative Example 3 containing the fine powders of the fluororesin in an amount of 0.7 parts by weight, and Comparative Example 4 containing the fine powders of the fluororesin in an amount of 2 parts by weight, cause high stain by paper rubbing, so that these toners are inferior in fixing ability. In view of the above, it can be seen that a toner to which the fine powders of the fluororesin are internally added in an amount of from 4 to 10 parts by weight is excellent in fixing ability.

Examples 5 to 28 and Comparative Examples 5 to 10

The amount 80 parts by weight of the resin A and 20 parts by weight of the resin B as resin binders, 6 parts by weight of a carbon black "MOGUL-L" (commercially available from Cabot Corporation) as a colorant, 1 part by weight of "BONTRON S-34" (commercially available from Orient Chemical Co., Ltd.) as charge control agent, and 2 parts by weight of a polyolefin wax "Hi-wax NP-105" (commercially available from MITSUI CHEMICALS, INC.) were mixed with a Henschel mixer. Thereafter, the mixture was melt-kneaded with a twin-screw extruder "PCM-45" (commercially available from IKEGAI Corporation), cooled with a drum flaker, and then roughly pulverized with a cutter mill. Thereafter, the roughly pulverized product was finely pulverized with a jet mill, and classified with a rotary stream classifier, to give mother toner particles "Toner A" (specific gravity of 1.2) having a volume-median particle size ($D_{50}$) of 8.5 μm.

In addition, the same procedures as described above were carried out except that 2 parts by weight of "Carnauba Wax C1" (commercially available from Kato Yoko) was used in place of 2 parts by weight of a polyolefin wax "Hi-wax NP-105," to give mother toner particles "Toner B" (specific gravity of 1.2) having a volume-median particle size ($D_{50}$) of 8.5 μm.

A hydrophobic silica "NAX50" (commercially available from Nippon Aerosil) and polytetrafluoroethylene "KTL-500F" (commercially available from KITAMURA LIMITED) as shown in Table 2 were simultaneously added to 100 parts by weight of the resulting mother toner particles, and the mixture was mixed with a Henschel mixer for 240 seconds. Thereafter, a hydrophobic silica "R-972" (commercially available from Nippon Aerosil) as shown in Table 2 was further added thereto and the mixture was mixed with a Henschel mixer for 240 seconds. Thereafter, the mixture was sieved through a wire mesh having a sieve opening of 100 μm, to give a negatively chargeable toner. Polytetrafluoroethylene "KTL-500F" was added to the mother toner particles without adding a hydrophobic silica "NAX50" thereto, and thereafter a hydrophobic silica "R-972" was added thereto, to prepare toners of Examples 25 to 28.

Test Example 2

Fixing Ability

The amount 6 parts by weight of the resulting toner and 100 parts by weight of a ferrite carrier (average particle size: 65 μm, saturation magnetization: 69 $\mu m^2/kg$) were loaded on a "Variostream 9000" commercially available from Oce Printing Systems GmbH, and 50,000 sheets were durably printed at a printing ratio of 9%. A tape peeling test and a paper rubbing test were carried out in a same manner as Test Example 1 to evaluate fixing ability. The results are shown in Table 2.

Test Example 3

Durability

The amount 6 parts by weight of the resulting toner and 100 parts by weight of a ferrite carrier (average particle size: 65 μm, saturation magnetization: 69 $Am^2/kg$) were loaded on a "Variostream 9000" commercially available from Oce Printing Systems GmbH, and fixed images were durably printed at a printing ratio of 9% for 2 hours. Thereafter, fixed images were durably printed at a printing ratio of 0.15% for 8 hours, and the printer was subjected to emergency shutdown. The amount of toner on the photoconductor (To) (g) and the amount of toner on the paper (Tp) (g) were weighed, and the value obtained by Tp/To×100 was defined as transferring efficiency (%) to evaluate durability. The results are shown in Table 2.

TABLE 2

| | | External Additive[1)] (Parts by Weight) | | | Total Coating Ratio of External Additive | Fixing Ability | | |
|---|---|---|---|---|---|---|---|---|
| | Mother Toner | Silica | | Fine Powders of Fluororesin | | Tape Peeling Residual Ratio | Stain by Paper Rubbing | Durability Transferring Efficiency |
| | Particles | R-972 | NAX50 | KTL-500F | (%) | (%) | (%) | (%) |
| Ex. 5 | A | 0.9 | 4.0 | 0.3 | 142.17 | 45 | 6 | —[2)] |
| Ex. 6 | A | 0.9 | 4.0 | 0.4 | 142.44 | 44 | 2 | 88 |
| Ex. 7 | A | 0.9 | 4.0 | 0.5 | 142.71 | 44 | 1.5 | 86 |
| Ex. 8 | A | 0.9 | 4.0 | 0.7 | 143.25 | 45 | 1.5 | — |
| Ex. 9 | A | 0.9 | 4.0 | 1.0 | 144.05 | 44 | 1.5 | — |
| Ex. 10 | B | 0.9 | 4.0 | 0.3 | 142.17 | 83 | 6 | — |
| Ex. 11 | B | 0.9 | 4.0 | 0.4 | 142.44 | 85 | 2 | 83 |
| Ex. 12 | B | 0.9 | 4.0 | 0.5 | 142.71 | 85 | 1.5 | 82 |
| Ex. 13 | B | 0.9 | 4.0 | 0.7 | 143.25 | 83 | 1.5 | — |
| Ex. 14 | B | 0.9 | 4.0 | 1.0 | 144.05 | 84 | 1.5 | — |
| Ex. 15 | A | 0.9 | 1.0 | 0.3 | 75.46 | 96 | 6.5 | — |
| Ex. 16 | A | 0.9 | 1.0 | 0.4 | 75.73 | 95 | 2 | 65 |

TABLE 2-continued

| | Mother Toner | External Additive[1] (Parts by Weight) | | | Total Coating Ratio of External Additive | Fixing Ability | | Durability |
|---|---|---|---|---|---|---|---|---|
| | | Silica | | Fine Powders of Fluororesin | | Tape Peeling Residual Ratio | Stain by Paper Rubbing | Transferring Efficiency |
| | Particles | R-972 | NAX50 | KTL-500F | (%) | (%) | (%) | (%) |
| Ex. 17 | A | 0.9 | 1.0 | 0.5 | 76.00 | 95 | 1.5 | 67 |
| Ex. 18 | A | 0.9 | 1.0 | 0.7 | 76.53 | 95 | 1.5 | — |
| Ex. 19 | A | 0.9 | 1.0 | 1.0 | 77.34 | 94 | 1.5 | — |
| Ex. 20 | B | 0.9 | 1.0 | 0.3 | 75.46 | 100 | 6 | — |
| Ex. 21 | B | 0.9 | 1.0 | 0.4 | 75.73 | 100 | 2.5 | 62 |
| Ex. 22 | B | 0.9 | 1.0 | 0.5 | 76.00 | 100 | 1.5 | 62 |
| Ex. 23 | B | 0.9 | 1.0 | 0.7 | 76.53 | 99 | 1.5 | — |
| Ex. 24 | B | 0.9 | 1.0 | 1.0 | 77.34 | 99 | 1.5 | — |
| Ex. 25 | A | 0.9 | 0.0 | 0.4 | 53.49 | 51 | 2.5 | 41 |
| Ex. 26 | A | 0.9 | 0.0 | 0.5 | 53.76 | 50 | 2 | 43 |
| Ex. 27 | B | 0.9 | 0.0 | 0.4 | 53.49 | 100 | 2 | 36 |
| Ex. 28 | B | 0.9 | 0.0 | 0.5 | 53.76 | 100 | 1.5 | 35 |
| Comp. Ex. 5 | A | 0.9 | 4.0 | 0 | 141.37 | 43 | 10.5 | — |
| Comp. Ex. 6 | A | 0.9 | 4.0 | 0.1 | 141.64 | 43 | 10 | 87 |
| Comp. Ex. 7 | A | 0.9 | 4.0 | 0.2 | 141.91 | 43 | 8 | — |
| Comp. Ex. 8 | B | 0.9 | 4.0 | 0 | 141.37 | 84 | 11 | — |
| Comp. Ex. 9 | B | 0.9 | 4.0 | 0.1 | 141.64 | 84 | 10 | 82 |
| Comp. Ex. 10 | B | 0.9 | 4.0 | 0.2 | 141.91 | 86 | 7.5 | — |

Note)

KTL-500F: polytetrafluoroethylene, commercially available from KITAMURA LIMITED, average particle size of 500 nm NAX50: hydrophobic silica, commercially available from Nippon Aerosil, hexamethyl disilazane as a hydrophobic treatment agent, average particle size of 55 nm R-972: hydrophobic silica, commercially available from Nippon Aerosil, dimethyl dichlorosilane as a hydrophobic treatment agent, average particle size of 21 nm

[1]The amount of the external additive is expressed by parts by weight, based on 100 parts by weight of the mother toner particles.

[2]No determination was carried out.

It can be seen from the above results that, when Comparative Examples 5 to 7 and Examples 5 to 9, in which mother toner particles are A, are compared, and when Comparative Examples 8 to 10 and Examples 10 to 14, in which mother toner particles are B, are compared, in a case where either mother toner particles are used, the toners of Examples do not dramatically lower a tape peeling residual ratio even the amount of the fine powders of the fluororesin externally added to the toner are increased, and dramatically lower stain by paper rubbing, so that these toners are excellent in fixing ability. In addition, Comparative Examples 6 and 9 containing the fine powders of the fluororesin in an amount of 0.1 parts by weight and Comparative Examples 7 and 10 containing the fine powders of the fluororesin in an amount of 0.2 parts by weight cause high stain by paper rubbing, so that these toners are inferior in fixing ability. In view of the above, it can be seen that, even when the mother toner particles have different compositions, a toner to which the fine powders of the fluororesin are externally added in an amount of 0.3 parts by weight or more is excellent in fixing ability. In addition, it can be seen that, when the fine powders of the fluororesin are externally added to a toner in an amount of 0.3 parts by weight or more and a total coating ratio of the external additive is 70% or more, the toner is excellent in durability in addition to fixing ability. Incidentally, it can be seen that a toner of which the weight ratio of "NAX50" and "R-972" that are other than the fine powders of the fluororesin, i.e., NAX50/R-972, is large, is more excellent in durability, even when it is a toner to which the fine powders of the fluororesin are externally added in an amount of 0.3 parts by weight or more and which uses mother toner particles having the same compositions (for example, a comparison between Examples 6, 7 and Examples 16, 17, a comparison between Examples 11, 12 and Examples 21, 22).

The toner and the two-component developer of the present invention are suitably used for, for example, developing a latent image formed in electrophotography, electrostatic recording method, electrostatic printing method, or the like.

The present invention being thus described, it will be obvious that the same may be varied in ways. Such variations are not to be regarded as a departure from the spirit and scope of the invention, and all such modifications as would be obvious to one skilled in the art are intended to be included within the scope of the following claims.

What is claimed is:

1. A toner in which mother toner particles comprising at least a resin binder and a colorant are coated with an external additive, wherein the mother toner particles comprise fine powders of a fluororesin having an average particle size of 1 μm or less in an amount of from 4 to 10 parts by weight, based on 100 parts by weight of the resin binder, wherein the external additive comprises fine inorganic particles A having an average particle size of from 5 to 100 nm and fine inorganic particles B having an average particle size of from 5 to 100 nm and which is smaller than the average particle size of the fine inorganic particles A, and wherein the weight ratio of the fine inorganic particles A to the fine inorganic particles B is from (4÷0.9) to 6.

2. The toner according to claim 1, wherein the fine powders of the fluororesin are polytetrafluoroethylene.

3. A two-component developer comprising the toner as defined in claim 1 and a carrier.

4. A method of forming fixed images, comprising the step of applying the two-component developer as defined in claim 3 in a non-contact fixing type image-forming apparatus to thereby form a fixed image.

5. The toner according to claim 1, wherein the fluororesin is present in an amount of from 6 to 10 parts by weight, based on 100 parts by weight of the resin binder.

6. The toner according to claim 1, wherein the fine inorganic particles A have an average particle size of from 10 to 60 nm.

7. The toner according to claim 1, wherein the fine inorganic particles B have an average particle size of from 5 to 60 nm.

8. The toner according to claim 1, wherein the fine inorganic particles B have an average particle size of from 10 to 50 nm.

9. The toner according to claim 1, wherein the average particle size ratio of the fine inorganic particles A to the fine inorganic particles B is from 1.2 to 5.

10. The toner according to claim 1, wherein the average particle size ratio of the fine inorganic particles A to the fine inorganic particles B is from 1.8 to 3.5.

11. The toner according to claim 1, wherein the fine inorganic particles A are present in an amount of from 3 to 10 parts by weight, based on 100 parts by weight of the mother toner particles.

12. The toner according to claim 1, wherein the fine inorganic particles B are present in an amount of from 0.5 to 4 parts by weight, based on 100 parts by weight of the mother toner particles.

13. The toner according to claim 1, wherein the weight ratio of the fine inorganic particles A to the fine inorganic particles B is from (4÷0.9) to 5.

14. The toner according to claim 1, wherein the fine inorganic particles A and B are silica particles.

* * * * *